US006085628A

United States Patent [19]

Street et al.

[11] Patent Number: 6,085,628

[45] Date of Patent: Jul. 11, 2000

[54] BUOYANT ROPE

[75] Inventors: Andrew John Street, Eastbourne; Christopher Clarke, Brighton, both of United Kingdom

[73] Assignee: Marlow Ropes Limited, Hailsham, United Kingdom

[21] Appl. No.: 09/029,410

[22] PCT Filed: Sep. 9, 1996

[86] PCT No.: PCT/GB96/02222

§ 371 Date: Aug. 20, 1998

§ 102(e) Date: Aug. 20, 1998

[87] PCT Pub. No.: WO97/09481

PCT Pub. Date: Mar. 13, 1997

[30] Foreign Application Priority Data

Sep. 7, 1995 [GB] United Kingdom ..... 9518281

[51] Int. Cl.[7] ..... D04C 1/12

[52] U.S. Cl. ..... 87/7; 57/210; 57/907; 87/5; 87/13; 114/230; 441/3; 441/23

[58] Field of Search ..... 87/5, 7, 13; 57/210, 57/235, 906, 907; 114/230; 441/3, 23

[56] References Cited

U.S. PATENT DOCUMENTS

| | | | |
|---|---|---|---|
| 3,295,489 | 1/1967 | Bossa | 114/206 |
| 3,405,516 | 10/1968 | Laureti | 57/210 |
| 3,526,086 | 9/1970 | Morgan | 57/149 |
| 3,578,763 | 5/1971 | Platou | 87/7 |
| 3,710,409 | 1/1973 | Davidson | 9/311 |
| 4,039,363 | 8/1977 | Robertson | 156/145 |
| 4,058,049 | 11/1977 | Bech | 87/6 |
| 4,593,599 | 6/1986 | Yeardley | 87/6 |
| 4,597,351 | 7/1986 | Brainard | 114/230 |
| 4,640,212 | 2/1987 | Brandt | 114/230 |
| 4,955,012 | 9/1990 | Bledsoe et al. | 367/154 |
| 5,522,674 | 6/1996 | Cooper | 405/66 |

FOREIGN PATENT DOCUMENTS

| | | |
|---|---|---|
| 50-000978 | 1/1975 | Japan . |
| 50-013859 | 5/1975 | Japan . |
| 1186968 | 4/1970 | United Kingdom . |
| 1 275 608 | 5/1972 | United Kingdom . |
| 1 278 938 | 6/1972 | United Kingdom . |
| 1 364 895 | 8/1974 | United Kingdom . |

*Primary Examiner*—William Stryjewski
*Attorney, Agent, or Firm*—Alix, Yale & Ristas, LLP

[57] ABSTRACT

A rope assembly comprises a central rope, which may be composed of nylon, a plurality of flotation elements of closed cell form and buffer elements of open cell form which are disposed between and flush with the flotation elements. A protective layer, which may be formed of polyurethane, surrounds the rope and the flotation and buffer elements. The closed cell form elements may be polyethylene. The open cell form elements may be polyurethane.

26 Claims, 2 Drawing Sheets

BUOYANT ROPE

CROSS-REFERENCE OF RELATED APPLICATION

This is the national stage of International Application No. PCT/GB96/02222 filed Sep. 9, 1996.

BACKGROUND OF THE INVENTION

The present invention relates to buoyant rope assemblies, and particularly, though not exclusively, to buoyant rope assemblies for use in mooring.

Known flotation systems for single point mooring (SPM) hawsers generally take the form of a number of discrete floats laced or slid onto the rope. Such systems allow the hawser to remain flexible because of the relatively large separation between the floats, but do have problems. For example, bending tends to be concentrated in the portions of the rope between the floats, which can lead to premature fatigue of these portions. Also, the changing cross-section of the rope/float assembly can lead to snagging.

Rope assemblies are also known in which a central rope is surrounded by a buoyant layer of closed cell foam extending along the full length of the rope, with a protective outer layer thereabout. These assemblies reduce the problem of snagging and premature fatigue mentioned above, but have other problems. For example, the relative inflexibility of the assembly can lead to buckling and compression of the foam when the rope is severely bent, such as during reeling or packing. Also, the foam layer tends to stretch less than the central rope to which it is attached, and this can lead to cracking and/or separation of the foam. If cracking does not occur, the mismatch in extension may result in crushing of the foam, thereby reducing buoyancy. Further, a hawser generally experiences continually fluctuating loads due to wave action, and this cyclic loading can induce heat build-up in the rope, which is detrimental to performance and durability. The foam layer can act as an insulator and can prevent this heat from dissipating.

BRIEF SUMMARY OF THE INVENTION

The present invention aims to provide an improved buoyant rope, and, viewed from one aspect, provides a buoyant rope assembly comprising a central rope, a plurality of closed cell foam flotation elements spaced along the rope, and elements of open cell foam between the flotation elements.

The open cell foam elements will generally, although not necessarily, be substantially shorter than the flotation elements, and may be thought of as "spacer" or "buffer" elements between the flotation elements.

The positioning of a number of open cell elements between a number of discrete flotation elements provides a flexible rope assembly, and the compressible nature of the open cell foam helps to prevent crushing of the flotation foam during for example packing. Further, the open cell foam and flotation elements may be flush with one another to provide an overall assembly of substantially constant cross-section to avoid snagging problems.

The open cell foam is able to absorb water, and this water may be pumped into and out of the open cell elements by the cyclic loading of the rope caused by wave action. In this way, the water in the open cell elements may be continually replaced to thereby dissipate heat from at least the regions surrounding these elements. Thus, in rope according to the present invention, the cyclic loading action which actually heats up the rope assembly may also be used to pump water from the open cell foam elements to dissipate the heat. The rope assembly may be configured so that it allows water pumped from the open cell foam to circulate along the length of the rope to provide greater heat dissipation. For example, the water may pass along the central rope and/or between the central rope and the flotation elements.

The rope assembly preferably includes a flexible outer layer which may be used for example to protect against abrasion, and/or to hold the flotation and open cell elements in place. Where an outer layer is provided which is waterproof, vent holes or other means may be provided at the locations of the open cell elements to allow for communication with the water to provide the cooling effects mentioned above.

The rope assembly may be made from any suitable materials. The central rope may be made from synthetic fibre, such as nylon or polyester, and may comprise one or more separate ropes or rope legs. The closed cell foam should have a density less than that of water, and may be for example polyethylene. The open cell foam may be for example polyurethane. The outer layer may be for, example polyurethane elastomer.

The manufacture of the rope assembly may be carried out in any suitable manner. In one preferred method, the flotation elements comprise layers of closed cell foam laminated about the central rope. The open cell material may also be laminated about the central rope between the flotation elements, or may be wrapped about it. The outer layer may be cast or poured over the assembly.

A mesh of for example polyester or nylon may be spirally wrapped around the foam elements or the same materials may be braided over the foam, before the polyurethane coating is applied, in order to reinforce e.g. the polyurethane elastomer skin to enhance abrasion resistance.

Other methods of manufacture are also possible.

For example, the open cell elements may be cast onto the central rope after mounting of the flotation elements, and the outer layer may be sprayed, extruded or braided onto the assembly.

In a further alternative arrangement, the outer layer may be cast first over each of the individual flotation elements, before addition of the open cell elements, and further outer layer material may then be cast over the open cell elements once added to overlap with the outer layer material over the flotation elements and complete the outer layer.

The flotation and open cell foam elements need not be adhered to the central rope. For example, they may comprise tubular elements which slide onto the rope or may be made from material wrapped about the rope and adhered to itself. An advantage of such an embodiment is that the central rope and flotation elements are able to stretch independently of each other, and any mismatch in stretch may be taken up by the open cell elements. This can prevent the flotation elements from cracking. Even when the flotation elements are connected directly to the central rope, the open cell foam elements can still provide some protection against cracking due to stretch mismatch.

The invention may be used with any suitable rope configurations. For example, the rope may take the form of a basic single length of rope, or it may be spliced at one or both ends to provide for example a grommet. In the latter case, the flotation assembly may be provided along the main length of the grommet between the spliced sections, and the increase in cross-section of the rope caused by the splicing may be minimised by omitting the flotation elements in the splicing areas, and by using only open cell foam to fair the tapered sections of the splices.

Although it is preferred for the flotation elements to be of closed cell foam, and to have elements of open cell foam therebetween, the two elements may be made of any other suitable materials, and, from a further aspect, the invention provides a buoyant rope assembly comprising a central rope, a plurality of flotation elements spaced along the rope, and buffer elements between the flotation elements, the buffer elements being more compliant than the flotation elements.

Embodiments of the present invention will now be described, by way of example only, with reference to the accompanying drawings, in which.

DETAILED DESCRIPTION OF THE PREFERRED EMBODIMENTS

Figure 1:
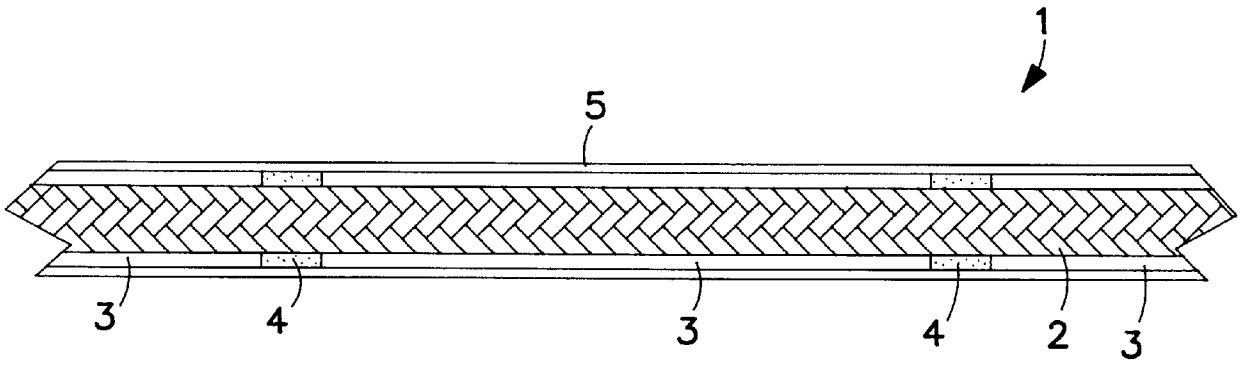
FIG. 1 is a cross-section through a buoyant rope assembly according to an embodiment of the invention.

Referring to FIG. 1, the rope assembly 1 comprises a central rope 2, for example of nylon, and a plurality of flotation elements 3 of closed cell foam, such as polyethylene, between which, and flush thereto, are buffer elements 4 of open cell foam, such as polyurethane. About the flotation and buffer elements 3, 4 is a protective outer skin 5 of for example polyurethane. Such an assembly may for example be used as a single point mooring rope for mooring oil tankers to floating buoys.

The flotation elements 3 provide the rope assembly 1 with buoyancy. The use of discrete flotation elements 3 with extensible open cell foam buffer elements 4 in between provides a flexible assembly, whilst the compressible nature of the open cell foam prevents crushing of the flotation foam during for example packing.

The outer skin 5 may have vent holes therein in the regions of the buffer elements 4 to allow water to be absorbed by the open cell foam material. This water may then be pumped in and out of the open cell material due to the wave action on the rope assembly, thereby dissipating heat, in at least this region, caused by the cyclic loading of the rope under the action of the waves. The arrangement may also be such that the water can circulate through the assembly along the rope 2 and/or between the rope 2 and flotation elements 3 to provide for greater and more uniform heat dissipation.

In one method of manufacture, the flotation elements 3 comprise laminated layers of closed cell foam which are wrapped around and adhered to the central rope 2, whilst the rope 2 is held under tension. The open cell material is then also wrapped around and adhered to the central rope 2 between the flotation elements, and the outer polyurethane skin is cast or poured over the assembly.

Figure 2:
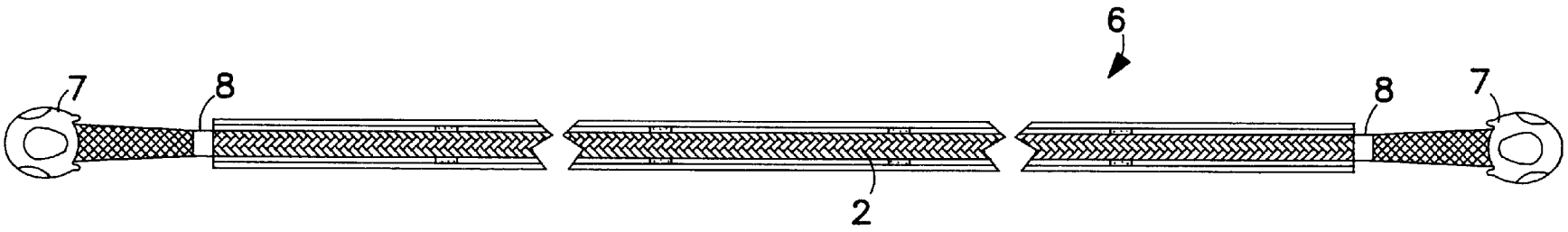
FIG. 2 is a cross-section through a rope assembly in accordance with FIG. 1, the rope being in the form of a grommet.
Figure 3:
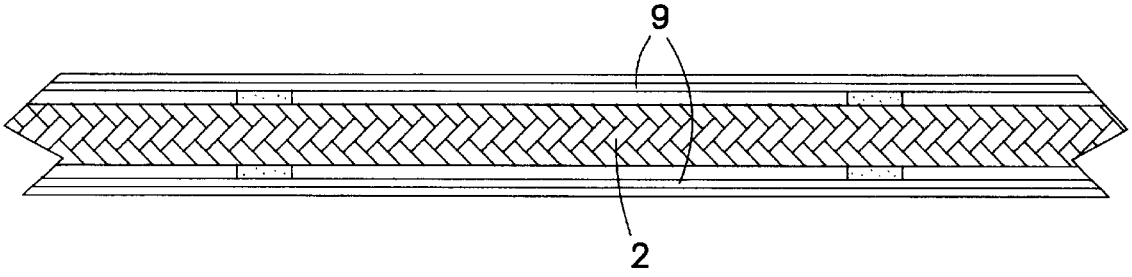
FIG. 3 is an enlarged fragmentary view of a form of the grommet of FIG. 2.

FIG. 2 shows the rope assembly of FIG. 1 in the form of a grommet 6, the central rope 2 being spliced at each end to provide eyes 7. In this embodiment, the flotation assembly is provided along the main length of the grommet 6. The increase in cross-section associated with the splices can be minimised by omitting flotation in this area, and by only wrapping open cell foam 8 over the tapered sections of the splice.

The above are only specific embodiments of the invention, and various modifications thereto are also possible. For example, other methods of manufacture are possible, and in one method, the open cell elements may be cast onto the rope 2 after mounting of the flotation elements 3. Also, the outer skin could be sprayed, extruded or braided on. The flotation elements 3 need not be adhered to the rope 2, and may be tubular elements slid onto the rope 2 or made from material wrapped about the rope 2 and adhered to itself. Such an embodiment allows the rope 2 and the flotation elements 3 to stretch independently of each other, with any mismatch in stretch being taken up by the more extensible open cell foam buffer elements 4. This can prevent cracking of the flotation foam. The grommet 6 may be assembled in either the shown single form or in a double form in which the rope is folded back on itself so that there are two parallel legs of rope between the eyes 7. In this case, the flotation assembly may be provided about each leg individually or may be provided about both legs together, the two legs forming the central rope 2.

In one example of a rope according to an embodiment of the invention which has been put into practice, a 160 mm diameter nylon rope was spliced endless to form a grommet. The two legs of the rope were lashed together at intervals and soft eyes were formed at each end. The overall length of the assembly was 36.5 merets.

One layer of 13 mm thick closed cell buoyant foam (polyethylene) was wrapped around the circumference of the grommet and stuck to the rope with contact adhesive.

This section of foam was positioned adjacent to the eye at one end of the rope. A second layer of closed cell foam was bonded to and on top of the first. The length of each foam section was one metre.

Two further thicknesses of closed cell foam were fitted in the same way a distance of about 300 mm from the first foam section. This process was repeated until the complete length of the rope, other than the soft eyes, was covered with one metre lengths of double thickness closed cell foam, each separated by 300 mm spaces.

The spaces between the buoyant foam sections were wrapped with open cell foam (polyurethane) to 26 mm thickness. The ends of the two buoyant foam sections that were adjacent to the soft eyes were tapered down to the rope diameter.

Nylon reinforcing mesh was spirally wrapped around the outside of the foam so that all of the foam between the eyes was completely covered. The mesh was secured at each end by covering with a rope lashing.

The complete rope was then coated with polyurethane. The polyurethane was poured over the top of the rope using a nozzle running up and down its length. The rope was then turned over to coat the other side in the same manner. The coating was then manually brushed out to smoothen it.

What is claimed is:

1. A buoyant rope assembly comprising a central rope defining a longitudinal axis, a plurality of longitudinally spaced closed cell foam flotation elements disposed around said central rope and extending longitudinally along the rope, and elements of open cell foam disposed between the flotation elements.

2. The rope assembly of claim 1, wherein the open cell foam elements are substantially shorter than the flotation elements.

3. The rope assembly of claim 1, wherein the open cell foam and flotation elements are flush with one another.

4. The rope assembly of claim 1, wherein the rope assembly is configured to allow water pumped from the open cell foam elements to circulate along the length of the rope.

5. The rope assembly of claim 1, wherein the rope assembly includes a protective outer layer.

6. The rope assembly of claim 5, wherein the outer layer is made of polyurethane.

7. The rope assembly of claim 5, wherein means are provided at the locations of the open cell elements to allow for communication with water through the outer layer.

8. The rope assembly of claim 1, wherein the central rope comprises one or more separate ropes or rope legs.

9. The rope assembly of claim 1, wherein the central rope is made from synthetic fibre.

10. The rope assembly of claim 1, wherein the closed cell foam is made from polyethylene.

11. The rope assembly of claim 1, wherein the flotation elements comprise layers of closed cell foam laminated about the central rope.

12. The rope assembly of claim 1, wherein the open cell foam is made from polyurethane.

13. The rope assembly of claim 1, wherein the open cell elements comprise open cell material wound about the central rope between the flotation elements.

14. The rope assembly of claim 1, wherein a reinforcing mesh is provided over the foam elements.

15. The rope assembly of claim 1, wherein the flotation and open cell foam elements are adhered to the central rope.

16. The rope assembly of any of claim 1, wherein the flotation and open cell foam elements comprise tubular elements which slide onto the rope or are made from material wrapped about the rope and adhered to itself.

17. The rope assembly wherein they of claim 1, wherein the central rope and flotation elements are able to stretch independently of each other.

18. The rope assembly of claim 1, wherein the central rope is formed into a grommet and comprising spliced sections at longitudinally spaced locations and wherein the flotation elements are provided along the rope between the spliced sections.

19. A buoyant rope assembly comprising a central rope defining a longitudinal axis, a plurality of longitudinally spaced flotation elements disposed around said rope and extending longitudinally along the rope, and buffer elements disposed between the flotation elements, the buffer elements being more compliant than the flotation elements.

20. A buoyant rope assembly comprising a central rope defining a longitudinal axis, a plurality of longitudinally spaced flotation elements disposed around said rope and extending longitudinally along the rope, spacer elements disposed between the flotation elements, and an outer protective layer surrounding the flotation and spacer elements.

21. A buoyant rope assembly comprising a central rope defining a longitudinal axis, a plurality of longitudinally spaded flotation elements disposed around said rope and extending longitudinally along the rope, buffer elements disposed between the flotation elements, the buffer elements being flush with the flotation elements, and an outer protective layer surrounding the buffer and flotation elements to provide a continuous flotation covering for the central rope.

22. A method of making a buoyant rope having a longitudinally axis, comprising the steps of spacing a plurality of closed cell foam flotation elements along the central rope at longitudinally spaced position, and placing elements of open cell foam between the flotation elements.

23. The method of claim 22, further comprising placing an outer protective layer over the closed and open cell elements.

24. The method of claim 22, further comprising individually coating each of the flotation elements with outer layer material, and placing outer layer material over the open cell elements to overlap with the outer layer material of the flotation elements, after the open cell elements have been mounted on the rope.

25. A method of making a buoyant rope assembly, comprising the steps of wrapping layers of closed cell foam at spaced apart locations along the length of a central rope, and wrapping open cell foam in the spaces between the closed cell foam.

26. The method of claim 25, wherein an outer protective layer is poured over the open and closed cell foam elements.

* * * * *

UNITED STATES PATENT AND TRADEMARK OFFICE

CERTIFICATE OF CORRECTION

PATENT NO. : 6,085,628
DATED : July 11, 2000
INVENTOR(S) : Street et al.

It is certified that error appears in the above-identified patent and that said Letters Patent is hereby corrected as shown below:

Column 6,
Line 12, delete “spaded” and insert -- spaced --.
Lines 19-20 delete “longitudinally” and insert --longitudinal --.

Signed and Sealed this

Twentieth Day of August, 2002

*Attest:*

*Attesting Officer*

JAMES E. ROGAN
*Director of the United States Patent and Trademark Office*